US007788073B2

(12) United States Patent
Hölzl

(10) Patent No.: US 7,788,073 B2
(45) Date of Patent: Aug. 31, 2010

(54) PROCESSES FOR DETERMINING THE STRENGTH OF A PLATE-TYPE EXCHANGER, FOR PRODUCING A PLATE-TYPE HEAT EXCHANGER, AND FOR PRODUCING A PROCESS ENGINEERING SYSTEM

(75) Inventor: Reinhold Hölzl, Geretsried (DE)

(73) Assignee: Linde Aktiengesellschaft, Munich (DE)

( * ) Notice: Subject to any disclaimer, the term of this patent is extended or adjusted under 35 U.S.C. 154(b) by 717 days.

(21) Appl. No.: 11/609,381

(22) Filed: Dec. 12, 2006

(65) Prior Publication Data

US 2007/0136037 A1 Jun. 14, 2007

Related U.S. Application Data

(60) Provisional application No. 60/780,108, filed on Mar. 8, 2006.

(30) Foreign Application Priority Data

Dec. 13, 2005 (DE) ..... 10 2005 059 993
Mar. 23, 2006 (EP) ..... 06006033

(51) Int. Cl.
*G06G 7/50* (2006.01)

(52) U.S. Cl. ..... 703/9; 165/173; 165/153; 165/172; 165/142; 165/80.3

(58) Field of Classification Search ..... 165/148, 165/152, 151, 80.4; 422/222; 228/183; 148/440, 148/528

See application file for complete search history.

(56) References Cited

U.S. PATENT DOCUMENTS 5,286,314 A * 2/1994 Das et al. ..... 148/528
5,332,455 A * 7/1994 Chang et al. ..... 148/440
6,299,994 B1 * 10/2001 Towler et al. ..... 429/17
6,321,566 B1 11/2001 Yamamoto et al.
6,942,018 B2 * 9/2005 Goodson et al. ..... 165/80.4

(Continued)

FOREIGN PATENT DOCUMENTS

DE 19809140 A1 9/1999

(Continued)

OTHER PUBLICATIONS

R. Poulter and M.A. Mehrabian Hydrodynamics and thermal characteristics of corrugated channels: computational approach Applied Mathematical Modeling 24 (2000) 343-364, Elsevier.*

(Continued)

*Primary Examiner*—Kamini S Shah
*Assistant Examiner*—Cuong V Luu
(74) *Attorney, Agent, or Firm*—Cahn & Samuels LLP

(57) ABSTRACT

A process for determining the strength of a plate-type heat exchanger includes computing the temperature stresses of the plate-type heat exchanger within the heat exchanger during its operation by a three-dimensional numerical simulation. Based on the computed temperature stresses, the strength of the plate-type heat exchanger is determined. The process for producing a plate-type heat exchanger with separating plates and profiles of metal uses this strength determination for establishing one or more mechanical parameters of the heat exchanger. The heat exchanger is manufactured with the one or more mechanical parameters.

27 Claims, 2 Drawing Sheets

U.S. PATENT DOCUMENTS

| | | | | |
|---|---|---|---|---|
| 6,991,024 | B2 * | 1/2006 | Goodson et al. | 165/80.4 |
| 7,024,342 | B1 * | 4/2006 | Waite et al. | 703/6 |
| 7,131,486 | B2 * | 11/2006 | Goodson et al. | 165/80.4 |
| 7,134,486 | B2 * | 11/2006 | Santiago et al. | 165/104.28 |
| 7,231,965 | B2 * | 6/2007 | Shimoya et al. | 165/151 |
| 7,334,630 | B2 * | 2/2008 | Goodson et al. | 165/104.33 |
| 2002/0164473 | A1 * | 11/2002 | Buckley | 428/308.4 |
| 2002/0164474 | A1 * | 11/2002 | Buckley | 428/308.4 |
| 2004/0035099 | A1 * | 2/2004 | Beldam et al. | 60/278 |
| 2004/0206484 | A1 * | 10/2004 | Shimoya et al. | 165/152 |
| 2004/0228781 | A1 * | 11/2004 | Tonkovich et al. | 422/222 |
| 2004/0234412 | A1 * | 11/2004 | Oishi et al. | 420/477 |
| 2004/0251013 | A1 * | 12/2004 | Kawakubo et al. | 165/172 |
| 2005/0006069 | A1 * | 1/2005 | Kamiyama et al. | 165/140 |
| 2005/0039885 | A1 * | 2/2005 | Vaidyanathan et al. | 165/80.4 |
| 2006/0048923 | A1 * | 3/2006 | Domen | 165/148 |
| 2006/0207757 | A1 * | 9/2006 | Danielsson et al. | 165/159 |
| 2006/0283585 | A1 * | 12/2006 | Smith et al. | 165/177 |
| 2007/0185694 | A1 * | 8/2007 | Rousselier et al. | 703/2 |
| 2008/0135603 | A1 * | 6/2008 | Geiger et al. | 228/183 |

FOREIGN PATENT DOCUMENTS

| | | | |
|---|---|---|---|
| EP | 1830149 | B | 9/2007 |
| FR | 2793701 | A1 | 11/2000 |
| FR | 2870590 | A1 | 11/2005 |
| JP | 2003075270 | A | 3/2003 |

OTHER PUBLICATIONS

Joel David Lindtrom Design and Evaluation of Compact Heat Exchanger for Hybrid Fuel Cell and Gas Turbine Systems, A thesis submitted in partial fulfillment of the requirements for the degree, Montana State University, Apr. 2005.*

Robert F. D. Perret High Temperature Heat Exchanger Project Quarterly Progress Report, Jan. 1, 2004 through Mar. 31, 2004 The UNLV Research Foundation.*

English Abstract of FR2793701.

English Abstract of DE 19809140.

English Abstract of WO 2005/124254 A1 corresponding to FR 2870590.

Carter, et al., "Failure Analysis and Life Prediction of a Large Complex Plate Fin Heat Exchanger", Engineering Failure Analysis, 1996, pp. 29-43, vol. 3, No. 1.

Nakaoka, et al., "Evaluation of Fatigue Strength of Plate Fin Heat Exchanger Under Thermal Loading", International Conference on Pressure Vessel Technology, ASME 1996, vol. 1.

Inomata, et al., "Thermal stress analysis of plate-fin heat exchanger", 15th Computational Mechanics Conference of Japan Society of Mechanical Engineers, pp. 487-488, 2002.

Dib, J., et al, "Application des techniques d'homogeneisation pour l'analyse tridimensionnelle d'echangeurs de chaleur a plaques et a ondes", Actes du 7eme Colloque National en Calcul des Structures, May 2005.

Noishiki, et al., "Development of High Pressure Large ALEX for Gas Processing Plants", Kobe Steel Engineering Reports, Sep. 2003, vol. 53, No. 2.

Mizoguchi, et al., "Fatigue Strength Corrugated Fin Type Heat Exchanger", ASME, Pressure Vessel & Piping 1982.

Nakagama, et al., "Three Dimensional Structural Analysis of the Plate Fin Heat Exchanger", ASME Pressure Vessel and Piping 1984.

English translation of JP-A-2003075270.

D. Averous, "Modelisation et simulation de echangeurs de chaleur multfluides a plaques brasees en configurations complexes", these de l'Institut National Polytechnique de Toulouse, 2000.

Pan, et al., "Modeling of a compact plate fin reformer for methanol steam reforming in fuel cell systems", Chemical Engineering Journal, 108, pp. 51-58, Feb. 2005.

"The standards of the brazed aluminum plate-fin heat exchanger manufacturers' association", ALPEMA, Second edition, 2000.

Kawashima et al., "High-temperature strength and inelastic behavior of plate-fin structures for HTGR", 18th International Conference on Structural Materials in Reactor Technology, SMiRT18, Beijing, about 2005.

Dib, J., et al, "Determination par homogenesation des proprietes mecaniques d'echangeurs de chaleur a plaques et ondes", 17eme Congres Francais de Mecanique, Sep. 2005.

English Abstract of Dib, J., et al, "Determination par homogenesation des proprietes mecaniques d'echangeurs de chaleur a plaques et ondes", 17eme Congres Francais de Mecanique, Sep. 2005.

English Abstract of Dib, J., et al, "Application des techniques d'homogeneisation pour l'analyse tridimensionnelle d'echangeurs de chaleur a plaques et a ondes", Actes du 7eme Colloque National en Calcul des Structures, May 2005.

Machine English Translation of Abstract of D. Averous, "Modelisation et simulation de echangeurs de chaleur multfluides a plaques brasees en configurations complexes", these de l'Institut National Polytechnique de Toulouse, 2000.

European Opposition Papers for EP 1830149.

* cited by examiner

Fig. 2
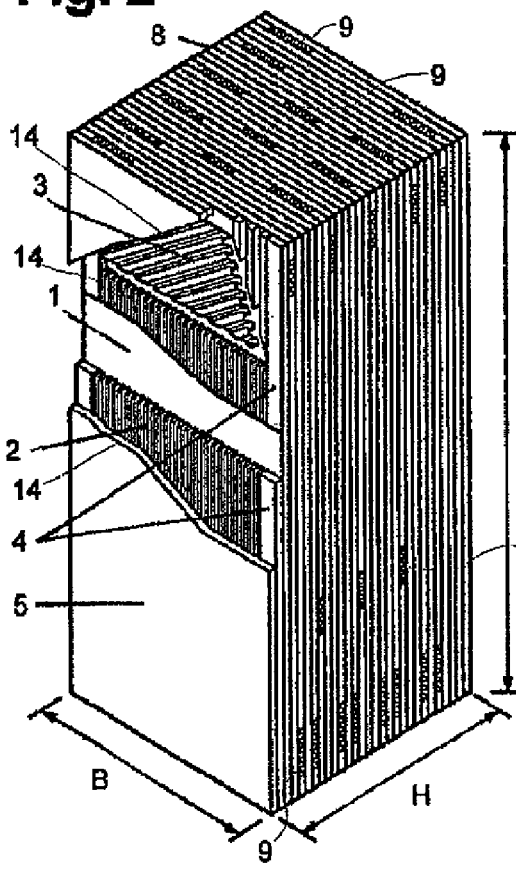
Fig. 1
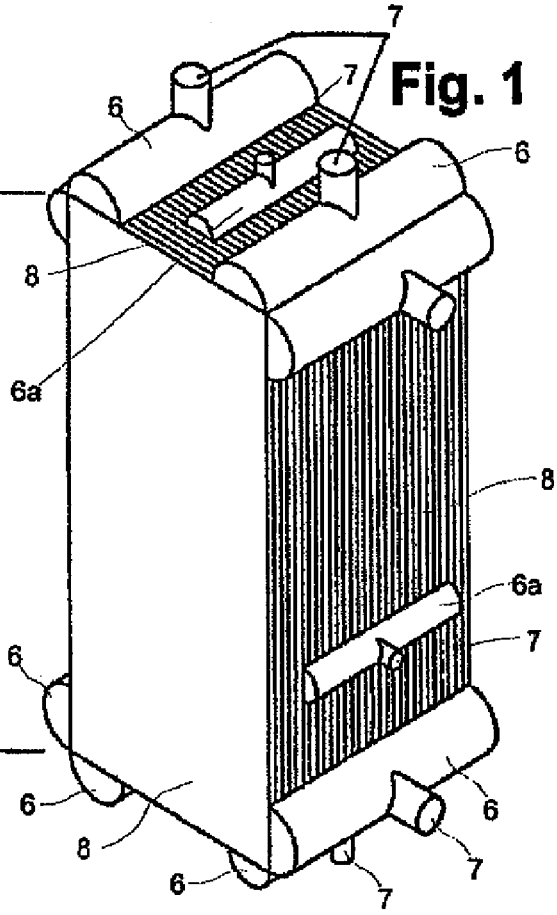
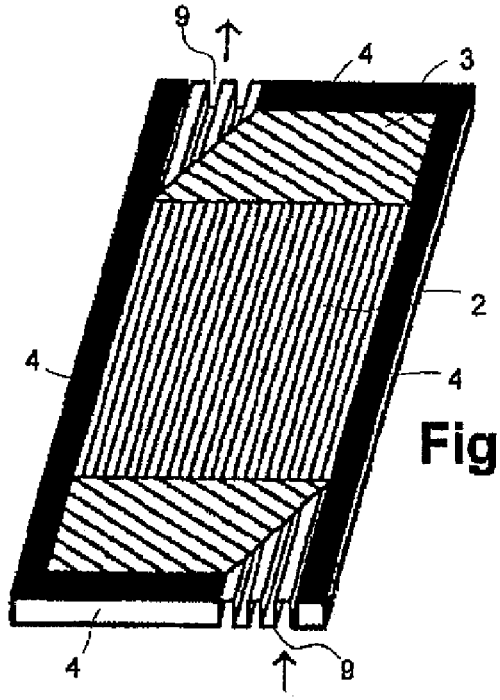
Fig. 3

PROCESSES FOR DETERMINING THE STRENGTH OF A PLATE-TYPE EXCHANGER, FOR PRODUCING A PLATE-TYPE HEAT EXCHANGER, AND FOR PRODUCING A PROCESS ENGINEERING SYSTEM

This application claims priority of German Application No. 102005059993.1, which was filed on Dec. 13, 2005; European Application No. 06006033.2, which was filed on Mar. 23, 2006; and U.S. provisional patent application Ser. No. 60/780,108 which was filed on Mar. 8, 2006, the disclosures of which are incorporated by reference herein in their entireties.

FIELD OF INVENTION

This invention relates to a process for determining the strength of a plate-type heat exchanger, a process for producing a plate-type heat exchanger, and a process for producing a process engineering system.

BACKGROUND OF INVENTION

Plate-type heat exchangers are known in numerous versions. Basically plate-type heat exchangers are designed to enable heat exchange between fluids, gases, or liquids which are flowing through. The fluids remain spatially separated so that no mixing takes place between them. The amounts of heat exchanged by the fluids therefore flow through the structures of the plate-type heat exchanger which separate the fluids. A "plate-type heat exchanger" for the purposes of this invention may comprise a plate-type heat exchanger block or of several plate-type heat exchanger blocks.

A plate-type heat exchanger has a plurality of passages through which the fluids can flow. A passage comprises heat exchange profiles, so-called fins, through which or along which the respective fluid flows, conventionally along ribs. Heat exchange profiles can be shaped rather differently and can have complex geometries. The passages are separated from one another by separating plates.

A process for producing plate-type heat exchangers may comprise for example the following: application of a solder to the surfaces of the separating plates; stacking the separating plates and profiles and optionally other structures present within a passage on top of one another in alternation; and soldering of the profiles to the separating plates. Soldering can take place for example in a furnace which encompasses the plate-type heat exchanger.

In particular, production of a plate-type heat exchanger can also comprise simulation of its operation. This is a good idea both in development in the run-up to actual production, and also to accompany production. In the former case, the knowledge of the results of this simulation can influence design. In the latter case, adaptive measures or else just checks can still be done. Simulation of existing plate-type heat exchangers enables improvement of the assessment of existing designs, for example, with reference to their failure risk.

Based on the amounts of heat exchanged within a plate-type heat exchanger, the fluids flowing through the plate-type heat exchanger have a three-dimensional temperature distribution which varies over time. An approximated determination of the temperature distribution along the flow direction of a fluid flowing through a passage using two-dimensional computer simulations is known. This also applies to the distribution of the heat transfer coefficient.

SUMMARY OF INVENTION

The object of this invention is to devise an advantageous process for determining the strength of a plate-type heat exchanger, an advantageous process for producing a plate-type heat exchanger, and an advantageous process for producing a process engineering system.

This object is achieved by a process for determining the strength of a plate-type heat exchanger comprising computing the temperature stresses of a plate-type heat exchanger within the heat exchanger during its operation by a three-dimensional numerical simulation. This process can be used, for example, for determining the strength of an existing plate-type heat exchanger. In the simulation, preferably in addition to temperature stresses, the compressive stresses of the plate-type heat exchanger are also computed. The computed compressive stresses may also be incorporated into the determination of the strength. The stresses are simulated during operation of the plate-type heat exchanger, therefore at least in one case of operation. Cases of operation are, for example, steady-state operation, operation under special conditions, underload operation or in general cases of operation under different load conditions, start-up, or shut down.

With respect to producing a plate-type heat exchanger, the object is achieved by a process in which determining the strength of a plate-type heat exchanger is used for design of a not yet existing plate-type heat exchanger. Three-dimensional simulation is part of the design, in which one or more mechanical parameters are determined for subsequent production of the plate-type heat exchanger.

The mechanical parameters which are established by simulation can be, for example, one or more of the following:

geometry of the partitions (separating plates), especially their thickness;

geometry of the profiles (fins), especially one or more of their height, division, or material thickness;

fin type, which is used as the profile: plain, perforated, serrated, wavy, herringbone pattern (according to ALPEMA Standard 2000, page 8);

number, geometry, and arrangement of empty passages;

number and arrangement of modules (a "module" constitutes a part, for example, a block of the heat exchanger which is prefabricated on one piece, for example by soldering, and which is assembled with one or more other modules into a plate-type heat exchanger).

With respect to production of a process engineering system, the aforementioned object may be achieved in a first version in which determining the strength of a plate-type heat exchanger is applied to an already existing plate-type heat exchanger. If the determined value for strength is not sufficient for the requirements of the process engineering system, the corresponding plate-type heat exchanger is not used or the system or its mode of operation is modified. Modification of the system can comprise, for example, in adding one or more lines, one or more shutoffs, one or more valves of the like.

A second version of the process for producing a process engineering system comprises first designing the plate-type heat exchanger with conventional means (i.e., especially without three-dimensional simulation of temperature stresses). The completely computed, but not yet finished, heat exchanger is subjected to three-dimensional simulation for determination of strength. If the strength is sufficient, the plate-type heat exchanger is produced accordingly and installed in the process engineering system. If not, the design is changed and the simulation is repeated one more time. This is repeated until sufficient strength has been achieved.

The inventor has ascertained that detailed simulation of the spatial temperature distribution in the material of a plate-type heat exchanger which takes into account especially the geometry of the profiles is not always practicable due to the size and complexity of the system. Even with the aid of high-speed computers, the computer time for a detailed simulation is a barrier which is serious in practice.

The simulation process used preferably in the invention is based on the finding that the temperature distribution in the material of the plate-type heat exchanger is determined largely by the heat flows flowing through the plate-type heat exchanger and for determining a relatively exact temperature distribution the full geometrical complexity of a real plate-type heat exchanger need not be considered.

The profiles can have a rather complex geometry.

Within the framework of continued development of the inventive idea, instead of a detailed model of a passage of a plate-type heat exchanger in which a complexly shaped profile is located between two separating plates, a simplifying layer model is used. In this layer model, the profile is modeled by a metal block which homogeneously fills the space between the separating plates.

This measure obviates the necessity of considering the real structure of the profile. The metal block directly adjoins the separating plates or is located between the two separating plates which encompass the modeled passage. There can also be a separating plate on one side of the metal block and a cover of the plate-type heat exchanger on the other. For the sake of simplification, only the case in which the metal block is surrounded by two separating plates is explicitly described here.

The real profile is soldered to its separating plates which encompass it. This connection conventionally has very good heat conduction. The metal block in the layer model is also in thermally conductive contact with the separating plates adjoining it, although over the entire contact place, for reasons of geometric simplification.

In a simple case, the layer model will have an "elementary cell" with two separating plates and a metal block located in between. Larger parts of a plate-type heat exchanger can be simulated by stacking many elementary cells or by arranging them in a row next to one another.

The layer model need not encompasses the fluid as such, but only its contribution to the heat introduced into the plate-type heat exchanger.

For the sake of simplicity, only the heat introduced from the fluid flowing into the material of the plate-type heat exchanger is addressed. In any case, heat introduced from the material of the plate-type heat exchanger flowing into the fluid can also take place equally well. Both possibilities are always intended, if not otherwise explicitly clarified.

In a real plate-type heat exchanger two possibilities for delivery of heat from the fluid into the plate-type heat exchanger can be distinguished. Initial heat introduction takes place by heat transfer from the fluid into the profile. Then heat exchange between the separating plates and the profile can take place by heat conduction. A second heat introduction from the fluid into the material of the plate-type heat exchanger can take place in many profiles by direct heat transfer from the fluid to the separating plates.

In the layer model, the initial heat introduction also corresponds to the total heat introduced and the first amount of heat is introduced into the first surface within the metal block. This surface is parallel to the separating plates. Proceeding from this surface, the heat is routed through the metal block into the separating plates (heat conduction). The basis for a corresponding model is the heat transfer coefficient which is already known along the flow direction of the fluid in a passage and which quantifies the transfer of the total heat introduced into the plate-type heat exchanger.

In a real plate-type heat exchanger, the heat flowing through the profile traverses paths of varied length to the separating plates depending on the position of the completed heat transfer.

In the layer model, it was decided to use a certain distance between the surface located in the metal block and the separating plates. This distance effectively combines the different path lengths within a real profile. For example, the distance between the surface in the metal block and the separating plates can be the average heat conduction length to be traversed, or the thermal conductivity of the metal block can be adapted.

This also easily enables direct heat transfer from the fluid into the separating plates without the need to separately consider heat introduction. A heat conduction length of zero is assigned to the corresponding regions of the plate-type heat exchanger. This can be easily considered in the distance between the surface located in the metal block and the separating plates in the layer model.

The layer model has various correction factors for adaptation of its properties in order to be able to adapt to real circumstances in spite of the geometrical complexity which is greatly reduced compared to that of a real plate-type heat exchanger.

Preferably an amount of heat corresponding to the second heat introduced is introduced into the second surface in the contact plane between the metal block and the separating plate. The total heat introduction is divided between the first and second heat introduction and the second heat introduced is explicitly modeled at the same time.

The amounts of heat introduced into the surfaces model the first and second heat introduction. However, this does not mean that the amount of heat introduced into the first surface of the layer model must correspond precisely to the amount of heat which the fluid introduces into the profile. The same applies accordingly to the amount of heat introduced into the second surface. The two heat inputs are divided using a model for division of heat introduction.

A simple model is for example to distribute the entire amount of heat simply in equal parts among the first and the second surfaces.

Preferably, the heat transfer coefficient for the heat transfer between the fluid and plate-type heat exchanger is multiplied by a heat transfer correction factor which corrects the heat introduction.

To do this, the previously determined heat transfer coefficient can be divided by the number of planes in the layer model by which heat is introduced.

If, for example, the metal block of the layer model is surrounded by two separating plates, one imaginary plane in the middle parallel to the separating plates and two imaginary planes are placed in the contact plane between the metal block and the separating plates, the layer model has a total of four imaginary surfaces. The heat transfer coefficient is divided by four in this case. Alternatively, division into more than four imaginary surfaces is also possible.

The consideration underlying this process is to divide the heat transfer coefficient by the number of "heat sources" in the layer model and to distribute the total heat introduction accordingly among the imaginary surfaces.

One aspect of the geometry of a real profile can also be easily considered. The heat transfer from the fluid into the profile takes place via so-called secondary surfaces. They correspond to the surfaces of parts of the profile, which surfaces lie between the separating plates and which parts do not adjoin the separating plate (see FIG. 4). The heat transfer from the fluid into the separating plates takes place via so-called primary surfaces. They are surfaces of the separating plates which are in direct contact with the flowing fluid or also those which are adjoined by the profile which can have a thickness which is low compared to the diameter of the passage (see FIG. 4).

Depending on the geometry of the profile, the secondary and primary surfaces can be in a very different ratio to one another. The amounts of heat introduced into the imaginary planes according to the ratio between the second and primary surfaces can be distributed among them. If, for example, a plate-type heat exchanger has a ratio of the secondary to the primary surfaces of 2:1, within the framework of the layer model twice as much heat can be introduced via the surface(s) located in the metal block than via the surface(s) in the contact plane(s).

Preferably, the area of the first and second surface is multiplied by a surface correction factor. In this way the entire surface via which heat is introduced into the layer model can be adapted to the entire surface via which heat is introduced into the plate-type heat exchanger.

If the heat transfer coefficient has already been divided by the number of imaginary surfaces in the metal block or otherwise adapted, the sum of the surfaces of the imaginary planes can be equated to the sum of primary and secondary surfaces of the real profile. It is a good idea to relate this adaptation to the aforementioned elementary cells.

If the heat transfer coefficient has not yet been adapted, the total heat introduction via the surfaces of the imaginary planes can also be adapted by equating the surface of an imaginary plane with an elementary cell to the sum of the primary and secondary surfaces of the real profile divided by the number of imaginary planes.

In the aforementioned example, an area which corresponds to the sum of primary and secondary surfaces of the real profile divided by four or a higher number would be assigned to each imaginary surface.

In a real plate-type heat exchanger only part of the space between the separating plates is occupied by the profile. Therefore in only one part of this space can heat conduction through the profile take place. The metal block in the layer model however takes up the entire space between the separating plates. It is preferred that the thermal conductivity coefficient of the metal block be multiplied by a thermal conductivity correction factor.

The thermal conductivity correction factor takes into account that heat conduction from the profile into the separating plates takes place only within the spatial extension of the profile and not outside it. The thermal conductivity correction factor can therefore correspond roughly to the ratio of the space not filled by the profile and the space filled by the profile.

Typically the profile between two separating plates has a repeating structure with a repetition length a (see FIG. 4). Within this repetition length, the profile often has two braces made as walls between the two separating plates. These walls have a thickness b. It is recommended that one of the two aforementioned elementary cells be examined per repetition length a.

The metal block of the layer model has a much higher heat capacity compared to the profile. The reason for this is also that the metal block fills the entire space between the separating plates, while the profile occupies only part of this space. Preferably, the heat capacity or density of the metal block is multiplied by a capacity correction factor.

It is especially preferred if this capacity correction factor corresponds to the ratio of the space not occupied by the profile and the space occupied by the profile.

The heat capacity itself, the specific heat capacity, or the density of the metal block can be multiplied by the capacity correction factor since these quantities are proportional to one another.

The temperature distribution can be simulated based on the layer model. Thus, a process is available which enables computation of the spatial temperature distribution in a plate-type heat exchanger with a model of little complexity.

Based on the temperature distribution determined by the layer model and the modulus of elasticity, the stress distribution in the layer model can be computed and thus the stress distribution in a real plate-type heat exchanger can be deduced.

The stress distribution results from the fact that the heat introduced into the metal block or separating plate would lead to a pure volume change of the metal block or separating plates if not opposed by constraints corresponding to the given geometry or construction. Instead of or in addition to volume changes, temperature-dependent stress changes occur. If the temperature distribution is known only once, stress changes can be computed.

The knowledge of the stress distribution in a plate-type heat exchanger is especially valuable since unfavorable stress conditions can destroy a plate-type heat exchanger or shorten its service life. The knowledge of these weak points can be advantageous both for existing plate-type heat exchangers in order to strengthen these weak points for example or to estimate the service life of the corresponding plate-type heat exchanger, and also for development and production of plate-type heat exchangers.

For the purpose of making the layer model less complex, preferably the modulus of elasticity of the metal block is selected to be isotropic. Thus, the modulus of elasticity for the metal block corresponds simply to a number although the real structure of the profiles is orthotropic or anisotropic. Alternatively to this isotropic model, an anisotropic or especially orthotropic model can be used.

To compute the stress distribution in the layer model, first the stiffness of the metal block is established. The metal block of the layer model is much stiffer than the profile of the plate-type heat exchanger. The reason for this is that the profile in the real plate-type heat exchanger is not solid and does not take up all the space between the separating plates.

It is preferred that the modulus of elasticity of the metal block be multiplied by a stiffness correction factor for correction of the stiffness of the metal block. It is especially preferred if the stiffness correction factor reflects the ratio of the space not occupied by the profile and the space occupied by the profile between the separating plates.

Conventionally the fluids are introduced into the plate-type heat exchanger with a certain pressure, so that this pressure interacts with the thermally induced stresses. It is preferred if, in the process described for determining the overall stress distribution, the operating pressure is superimposed on the thermally induced stress distribution. The pressure distribution is superimposed on the stress values of the thermally induced stress distribution which were determined using the layer model in order to form an overall stress distribution.

Due to the construction and installation of the plate-type heat exchanger, stresses additional to those caused by a non-uniform temperature distribution arise. These construction-dictated stresses are called clamping boundary conditions.

These clamping boundary conditions are preferably superimposed on the thermally dictated stress values determined from the layer model.

If the modulus of elasticity of the metal block has been multiplied by the stiffness correction factor, it is preferred that the values of the stress distribution be multiplied by a correction factor for the modulus of elasticity. If the modulus of elasticity has been multiplied by the stiffness correction factor, specifically the stresses are computed to be correspondingly small. Instead of multiplying the stresses by the correction factor, this factor can also be taken into account in an evaluation using comparison stresses and the comparison stresses can be reduced accordingly.

Comparison with results of detailed simulations which have not been done using the layer model, but which took into account the real geometry of the plate-type heat exchanger as much as possible, led to the result that the stresses determined using the layer model are determined to be too small. Therefore, the stresses determined using the layer model are multiplied by a stress increasing factor of preferably 1.3 to 2.8. Alternatively, comparison stresses for evaluation of the stress distribution can also be reduced accordingly.

The metal of the metal block may comprise, for example, aluminum or steel.

The foregoing and the following description of individual features relates to the process for simulation of a plate-type heat exchanger, to the process for producing a plate-type heat exchanger, and to the computer program product with a program for carrying out a simulation of a plate-type heat exchanger. This also applies without its being explicitly mentioned in particular.

BRIEF DESCRIPTION OF DRAWINGS

The invention is described below using embodiments, and the individual features can also be critical to the invention in other combinations. In an embodiment, the plate-type heat exchanger comprises a single heat exchanger block.

FIG. 1 shows a plate-type heat exchanger schematically and in perspective from outside with fittings;

FIG. 2 shows the plate-type heat exchanger from FIG. 1 with a partially omitted cover sheet without fittings.

FIG. 3 shows a passage from the plate-type heat exchanger of FIGS. 1-2 schematically and in perspective.

DETAILED DESCRIPTION OF INVENTION

Figure 4:
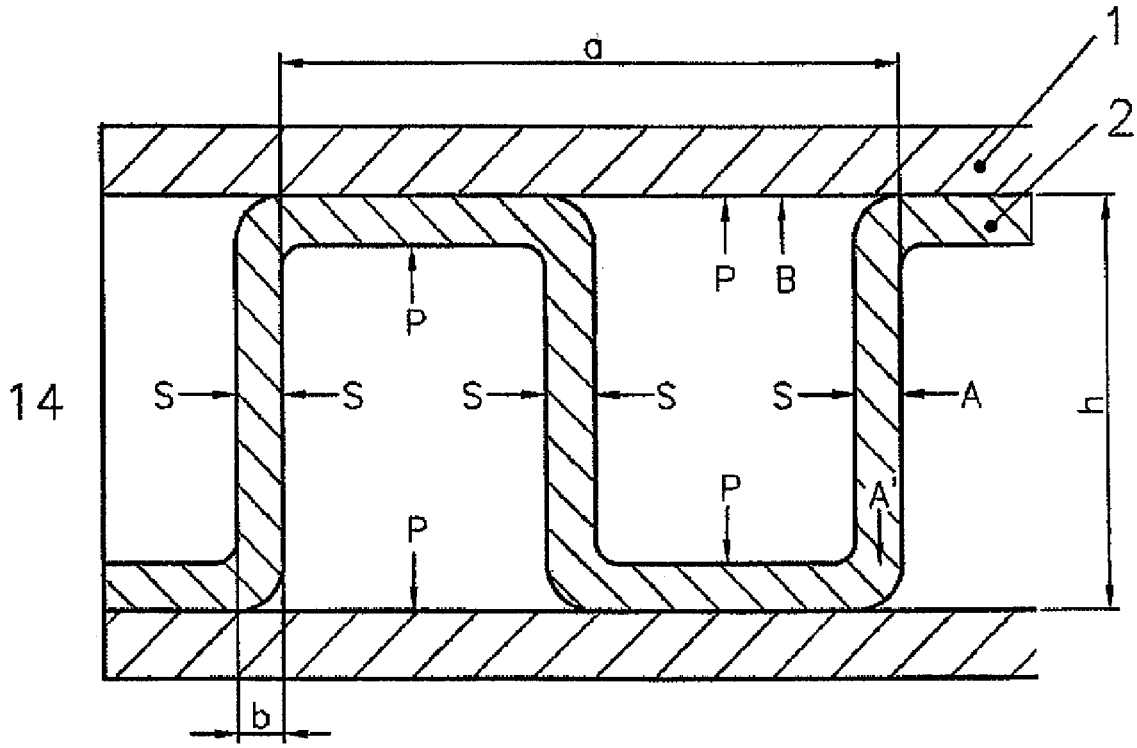
FIG. 4 shows a section from a heat exchange profile of the passage from FIG. 3.

FIG. 1 shows a plate-type heat exchanger from the outside. The plate-type heat exchanger has a central cuboid 8 with a length L of 6 m and a width and height B, H of 1.2 m each. Attachments 6 and 6*a* are recognizable at the top on the cuboid 8, on its sides and underneath the cuboid 8. There are also such attachments 6 and 6*a* underneath the cuboid 8 and on the side facing away from the illustrated side. These attachments are however partially hidden. A fluid, in this case water, can be supplied to the plate-type heat exchanger or removed from it through nozzles 7. The attachments 6 and 6*a* are used to distribute the water introduced through the nozzles 7 or to collect and concentrate the water to be removed from the plate-type heat exchanger. Within the plate-type heat exchanger, the different water streams exchange heat energy.

The plate-type heat exchanger shown in FIG. 1 is designed to route more than two water streams in separate passages past one another for heat exchange. Some of the streams can be routed past one another in opposite directions, some via crossing. To explain the invention the simplified situation is examined in which two water streams flow past one another in separate alternating passages. Larger numbers of water streams do not engender any additional qualitative questions.

FIG. 2 shows how the plate-type heat exchanger is internally built. Essentially it is a cuboid 8 of separating plates 1 and heat exchange profiles 2, so-called fins 2, or distributor profiles 3. Layers which have separating plates 1 and profiles 2 and 3 alternate. A layer which has a heat exchange profile 2 and distributor profiles 3 is called a passage 14 (this passage is shown in FIG. 3).

The cuboid 8 therefore has passages 14 and separating plates 1 parallel to the flow directions in alternation. Both the separating plates 1 and also the passages 14 are made of aluminum. To their sides the passages 14 are closed by aluminum beams 4 so that a side wall is formed by the stacked construction with the separating plates 1. The outside passages 14 of the cuboid 8 are hidden by an aluminum cover 5 which is parallel to the passages and the separating plates 1.

The cuboid 8 was produced by applying a solder to the surfaces of the separating plates 1 and subsequently stacking the separating plates 1 and passages 14 on top of one another in alternation. The covers 5 cover the stack 8 to the top or bottom. Then the stack 8 was soldered by heating in a furnace encompassing the stack 8.

On the sides of the plate-type heat exchanger the distributor profiles 3 have distributor profile accesses 9. Water can be introduced into the pertinent passages 14 via the attachments 6 and 6*a* and nozzles 7 or also removed again through these accesses. The distributor profile accesses 9 shown in FIG. 2 are hidden by attachments 6 and 6*a* in FIG. 1.

FIG. 3 shows one of the passages 14 of the plate-type heat exchanger shown in FIGS. 1 and 2. The flow direction of the water is identified by arrows. On one distributor profile access 9 the water flows in to be distributed in the pertinent distributor profile 3 over the entire width of the passage 14. Then the water flows through the heat exchange profile 2 and is concentrated after completed heat exchange from the other distributor profile 3 to the output-side distributor profile access 9. The passage 14 is bordered on its long and short sides by the beams 4.

To promote swirling of the water and thus to benefit heat transfer, the heat exchange profiles 2 in the example comprise serrated fins.

Depending on the temperatures produced by the heat flows flowing through the plate-type heat exchanger during operation, the separating plates 1 and profiles 2 and 3 execute thermal expansion changes. This can lead to stresses which can damage a plate-type heat exchanger.

The stress distribution is determined by simulation of the temperature distribution which is based on these heat flows in the plate-type heat exchanger. Based on these simulated stress distributions, failure risks can be estimated or even improved plate-type heat exchangers can be built.

In order to determine the stress distribution in a plate-type heat exchanger, first the spatial temperature distribution (a) is determined using a layer model and from it, the stress distribution (b) is determined.

1. Approximation Model 1.1 Layer Model and Temperature Distribution

It is known from process engineering that the water temperature and heat transfer coefficient along the flow direction parallel to the separating plates 1 can be determined by simulation. For each passage 14 therefore the two-dimensional simulated temperature distribution of water parallel to the separating plates is known. For this purpose MUSE software in combination with MULE from AspenTec has been used. (Instead, other computation tools for plate-type heat exchangers can also be used). Based on the temperature distribution and heat transfer coefficient using the model described below (FIG. 5) the temperature distribution in the aluminum of the plate-type heat exchanger is determined.

FIG. 4 schematically shows first of all a cross section through the heat exchange profile from FIG. 3 perpendicular to the flow direction, the passage 14 being bordered at the top and bottom by the separating plates 1. The heat exchange profile 2 has a height h (e.g., 1 cm) and fills the space between the two separating plates 1. The thickness of the profile 2 is b (e.g., 0.5 mm).

The heat exchange profile 2 perpendicular to the flow direction has a repeating structure with a repetition length a, in this case 1.5 cm. The separating plates 1 are soldered to the heat exchange profile 2 so that contact between the heat exchange profile 2 and the separating plates 1 has a thermal conductivity which can be equated to that of aluminum without any boundary surfaces.

Figure 5:
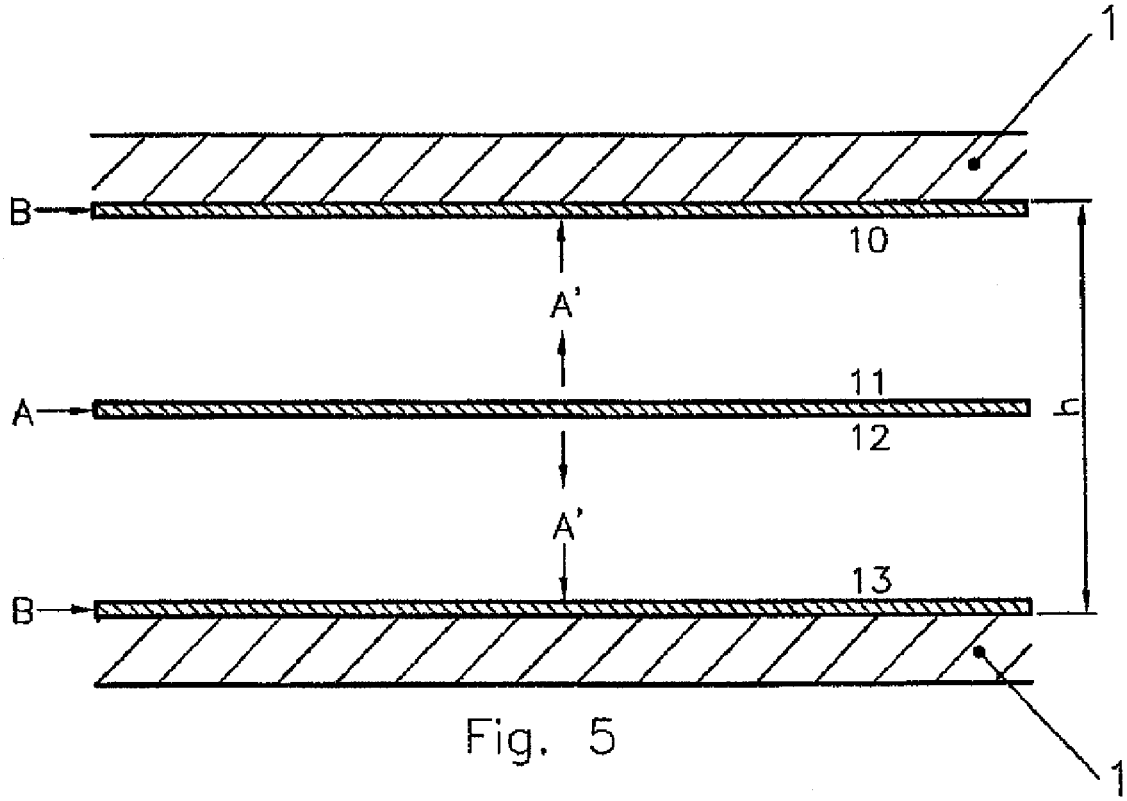
FIG. 5 shows a schematic of the heat exchange profile from FIG. 4.

The water flowing through this heat exchange profile 2 (in this case hot water) gives up heat to the heat exchange profile 2 and the separating plates 1. In this connection, the side surfaces of the heat exchange profile 2 which are aligned along the vertical line in FIGS. 4 and 5 are called secondary surfaces S and the surfaces parallel to the separating plates 1 are called primary surfaces P.

The water gives up heat to the heat exchange profile 2 and separating plates 1 by heat transfer via these primary and secondary surfaces.

Here, above and below this passage (not shown) there are passages with cold water. Therefore, the heat flows out, up, and down.

Heat transfer into the secondary surfaces S takes place by heat transfer into the heat exchange profiles 2 and via heat conduction therein into the separating plates 1. This path of heat flow is identified by the letters A and A' in FIG. 4.

For the sake of simplification, a section of passage 14 will be considered here, with a water temperature which is locally homogenous in this cross section and is determined using MUSE/MULE.

The letter B labels the heat introduction into the separating plates 1 by heat transfer into them. The profile thickness b is small compared to the height of the heat exchange profile, and the heat transfer between the heat exchange profile 2 and the separating plates 1 can be equated to that in contact with the thermal conductivity of aluminum without any boundary surfaces. Therefore, it is unnecessary to distinguish whether heat transfer takes place directly from the water into the separating plate 1 or whether there is a heat exchange profile adjoining the separating plates in between.

If the temperature distribution in aluminum is to be determined based on detail faithfulness corresponding to FIG. 4, the performance limits of current computers are quickly reached. The feedback of the temperature distribution to heat flows by a geometry corresponding to FIG. 4 is so complex that a temperature and stress distribution for satisfactorily large sections of the plate-type heat exchanger cannot be determined in a reasonable time.

FIG. 5 shows a simplifying layer model of the section of the plate-type heat exchanger shown in FIG. 4.

The separating plates 1 as before are at a distance h parallel to one another. The intermediate space between the separating plates 1 is in any case not filled by the heat exchange profile 2 from FIG. 4 and water, but the intermediate space is filled completely by an imaginary aluminum block. The aluminum block is placed directly against the separating plates 1 so that heat conduction which takes place between the aluminum block and the separating plates can proceed unhindered.

The heat is introduced into the aluminum block and the separating plates 1 via four imaginary surfaces 10-13. The surfaces 10 and 13 are each in contact with the aluminum block and the bordering separating plates 1. The surfaces 11 and 12 directly adjoin one another in the middle within the aluminum block. Energy corresponding to the heat transfer is delivered into the aluminum block and separating plates 1 via these four surfaces 10-13. The heat transfer coefficient determined beforehand (see A and B in FIG. 4) must be reduced since here heat is introduced via several "sources". An amount of heat corresponding to the heat flow A in FIG. 4 is introduced via the surfaces 11 and 12 and an amount of heat corresponding to the heat flow B in FIG. 4 is introduced via the surfaces 10 and 13.

Since the separating plates 1 are surrounded by colder passages above and below the extract shown in FIG. 5, heat flows from the upper surface 10 into the upper separating plate 1 and from the lower surface 13 into the lower separating plate 1. For the same reason the heat introduced via the surface 11 is routed through the aluminum block in the direction of the upper separating plate 1 via heat conduction. The heat introduced via the surface 12 is routed in the direction of the lower separating plate 1.

In order to adapt heat flows and thus the temperature distribution in the model corresponding to FIG. 5 as much as possible to those in the passage corresponding to FIG. 4, the total interaction area (the entire area comprising the surfaces 10, 11, 12, 13) as a geometrical property and other thermal properties are adapted.

The total interaction area comprises an area which corresponds to the sum of the primary and secondary surfaces from FIG. 4.

The layer model from FIG. 5 is based on an aluminum block which is isotropic with respect to its thermal properties. If the thermal conductivity of this aluminum block were not adapted, the thermal conductivity from surfaces 11 and 12 in the direction of surfaces 10 and 13 would be much too high, since it is not considered that for the heat exchange profile 2 corresponding to FIG. 4 it can only route heat into the separating plates 1 over its width b. To take this into account, the thermal conductivity coefficient of the aluminum block is multiplied by a corresponding correction factor.

The heat capacity of the aluminum block from FIG. 5 is much higher than the heat capacity of the heat exchange profiles 2 from FIG. 4. Since the heat capacity is proportional to the density of the material, the density of the aluminum block is multiplied by a density correction factor. This yields a correspondingly reduced heat capacity.

The known heat introductions make it possible to compute the temperature distribution in the aluminum block and in the separating plates along the passage height.

1.2 Stress Distribution

The stress distribution is computed based on the temperature distribution as determined above.

The plate-type heat exchangers shown in FIG. 1 and FIG. 2, as well as the passage shown in FIG. 3 and the heat exchange profile from FIG. 4, are mechanically orthotopic systems. With them a temperature-induced stress change cannot be deduced directly from the temperature, but first the stiffness must be determined or established.

To establish the stiffness, the modulus of elasticity of the aluminum block (FIG. 5) must be reduced by a stiffness correction factor. Thus, the stiffness of the heat exchange profile reduced by the geometry is considered. That the heat exchange profile 2 from FIG. 4 with respect to its stiffness is anisotropic is ignored in this embodiment to limit computation cost. The modulus of elasticity is therefore an isotropic quantity in the entire aluminum block. Alternatively, anisotropic properties can be considered.

Based on the temperature distribution, the stiffness of the aluminum block and the separating plates 1, and the modulus of elasticity as selected above, the stress distribution can be determined.

The stresses determined in this way are in any case too low because the modulus of elasticity established for the aluminum block is too small. To compensate for this, the stress is multiplied by a correction factor for the modulus of elasticity. Alternatively, this factor can also be incorporated in the evaluation of stresses and evaluation stresses which may be present can be scaled down.

By comparison with results of various detailed simulations which were carried out for a small, two-dimensional section in the flow direction perpendicular to the separating plates of a plate-type heat exchanger, it was established that these stresses are defined too small. Therefore here the stresses are multiplied once by a stress increasing factor of, for example, 2.6. Optionally evaluation stresses which may be present can be rescaled accordingly.

Detailed simulations were not carried out using the model described in FIG. 5, but the geometry of the heat exchange profiles 2 was modeled as in FIG. 4 according to reality. The resulting computation cost is so high that only small sections from plate-type heat exchangers can be computed.

Thus the thermally induced stresses are known. The three-dimensional distribution of the total stress is determined by application of the operating pressure and stress boundary conditions (see below).

2. Example for Sequence of a Simulation According to the Invention:

2.1 Preparation of Plate-Type Heat Exchanger Geometry

A representation of the plate-type heat exchanger geometry according to the simulation software (MARC) used later is prepared by a preprocessor program (MENTAT) for configuration data files. Both MARC and also MENTAT are software products from MacNeal-Schwendler Corp. (MSC). Alternatively, finite element systems can also be used for carrying out simulation within the framework of the invention.

A plate-type heat exchanger can have several different passage types which can differ, for example, in the heat exchange profile (fins). A first configuration data file contains the stacking sequence of the passages. Other configuration data files each contain geometry information about the separating plates 1, covers 5, beams 4, and other geometrical properties of the plate-type heat exchanger. Passages can also be divided into zones, in which for example a medium flows and heat is exchanged with adjacent passages (active zones) or in which a medium does not flow (passive zones). These zones can also be described in the configuration data file.

2.2 Initial Adaptations Based on the Layer Model

The passages are each divided into two sections lying on top of one another. The division corresponds to the gradient of the inner surfaces 11, 12.

2.3 Preparation of Attachments

The attachments 6 and **6*a*** are linked to the passages. Ordinarily these attachments are made in the shape of half tubes.

2.4 Other Model Properties

Geometrical, mechanical, and thermal properties according to the process are assigned to model parts (see above). In particular, the heat exchange profiles are not modeled with their actual geometry, but are replaced by the above described aluminum block.

2.5 Incorporation of Boundary and Initial Conditions

These conditions comprise one or more of:

pressure on the outer surfaces of all flow-carrying passages;

pressure in the region of the attachments;

flow temperature and heat transfer coefficient for all flow-carrying passages, as described above;

stress boundary conditions (the stress boundary conditions (clamping situation) can be known from the development or production of the plate-type heat exchanger).

The flow temperature and heat transfer coefficient are preferably available for active zones of the passages. For passive zones, the corresponding values are constantly continued and linearly interpolated. Alternatively, the flow temperature and heat transfer coefficient are also used in passive zones when they are available.

The temperature of the aluminum of the plate-type heat exchanger is set to a certain value, for example 20° C., as the initial condition of the simulation.

Within the framework of the layer model, important quantities such as the heat transfer coefficient or the flow temperature or also the operating pressure can be stipulated, of course also as a function of time, so that transient events can be modeled and the corresponding stress characteristics can be determined.

2.6 Progression of Computations

The metal temperature distribution is determined based on the thermal boundary conditions and the simulation scenario.

The computation of the stress distribution is based on the temperature distribution. The program computes the stress distribution via the displacement distribution from the pressure, stress boundary conditions, and temperature distribution. The displacement distribution corresponds to the geometry of the plate-type heat exchanger with mechanical constraints.

2.7 Evaluation of Stresses

The stress distribution within the plate-type heat exchanger can be simulated using the simplifying model by this process. To evaluate these stresses there are comparison stresses in the form of recommendations and regulations. Thus, it is now possible to compare the stress distribution of a complete plate-type heat exchanger, and not only sections of it, to the comparison stresses. Also other components of the plate-type heat exchanger such as, for example, the attachments can be incorporated into the simulation of the time and space distribution of the temperature stresses.

The simulation can comprise various operating cases, for example steady-state operation, operation under special conditions, underload operation or in general cases of operation under different load conditions, start-up or shut down.

What is claimed is:

1. Process for determining the strength of a plate-type heat exchanger, comprising:

computing temperature stresses of a plate-type heat exchanger within the heat exchanger during its operation by a three-dimensional numerical simulation, said plate-type heat exchanger comprising layers, each layer comprising separating plates and a profile located between the separating plates, said profile comprising a profile part extending between the separating plates and adjoining the separating plates; and determining the strength of the plate-type heat exchanger based on the computed temperature stresses, wherein in the three-dimensional numerical simulation, a spatial temperature distribution in the profile and in the separating plates is determined by using a layer model comprising:

modeling the profile part as a metal block that fills the space between the separating plates and comprises two planes, each plane in thermally conductive contact with a separating plate, and at least one plane having two surfaces between and parallel to the separating plates;

determining a total heat introduced via a fluid into the profile part and into the separating plate with a first heat introduction comprising heat transfer from the fluid into the profile part and subsequent heat conduction through the profile part and from the profile part into the separating plate; and introducing an amount of heat corresponding to the first heat introduction into a first surface within the metal block.

2. Process as claimed in claim 1, wherein steady-state and transient temperature stresses are computed by the simulation.

3. Process for producing a plate-type heat exchanger, comprising:

computing temperature stresses within a plate-type heat exchanger during its operation by a three-dimensional numerical simulation, said plate-type heat exchanger comprising layers, each layer comprising separating plates and a profile located between the separating plates, said profile comprising a profile part extending between the separating plates and adjoining the separating plates;

determining the strength of the plate-type heat exchanger based on the computed temperature stresses;

determining one or more mechanical parameters of the plate-type heat exchanger; and manufacturing the plate-type heat exchanger with the one or more mechanical parameters, wherein in the three-dimensional numerical simulation, a spatial temperature distribution in the profile and in the separating plates is determined by using a layer model comprising:

modeling the profile part as a metal block that fills the space between the separating plates and comprises two planes, each plane in thermally conductive contact with a separating plate, and at least one plane having two surfaces between and parallel to the separating plates;

determining a total heat introduced via a fluid into the profile part and into the separating plate with a first heat introduction comprising heat transfer from the fluid into the profile part and subsequent heat conduction through the profile part and from the profile part into the separating plate; and introducing an amount of heat corresponding to the first heat introduction into a first surface within the metal block.

4. Process for producing a process engineering system having at least one plate-type heat exchanger, comprising:

manufacturing the at least one plate-type heat exchanger, said at least one plate-type heat exchanger comprising layers, each layer comprising separating plates and a profile located between the separating plates, said profile comprising a profile part extending between the separating plates and adjoining the separating plates;

computing temperature stresses within the at least one plate-type heat exchanger during its operation by a three-dimensional numerical simulation;

determining the strength of the at least one plate-type heat exchanger based on the computed temperature stresses; and depending on the result of the strength determination, deciding at least one of whether the at least one plate-type heat exchanger is used in the process engineering system or whether the system and/or its mode of operation is modified, wherein in the three-dimensional numerical simulation, a spatial temperature distribution in the profile and in the separating plates is determined by using a layer model comprising:

modeling the profile part as a metal block that fills the space between the separating plates and comprises two planes, each plane in thermally conductive contact with a separating plate, and at least one plane having two surfaces between and parallel to the separating plates;

determining a total heat introduced via a fluid into the profile part and into the separating plate with a first heat introduction comprising heat transfer from the fluid into the profile part and subsequent heat conduction through the profile part and from the profile part into the separating plate; and introducing an amount of heat corresponding to the first heat introduction into a first surface within the metal block.

5. Process for producing a process engineering system having at least one plate-type heat exchanger, comprising:

designing at least one plate-type heat exchanger, said at least one plate-type heat exchanger comprising layers, each layer comprising separating plates and a profile located between the separating plates, said profile comprising a profile part extending between the separating plates and adjoining the separating plates;

computing temperature stresses within the at least one plate-type heat exchanger during its operation by a three-dimensional numerical simulation;

determining the strength of the at least one plate-type heat exchanger based on the computed temperature stresses; and checking whether the determined strength corresponds to requirements for a process engineering system;

wherein if the strength is sufficient, the at least one plate-type heat exchanger is manufactured with the current design and is provided for installation in the process engineering system, wherein if the strength is not sufficient, the design is changed and said performing the strength determination and said checking the determined strength are repeated, wherein in the three-dimensional numerical simulation, a spatial temperature distribution in the profile and in the separating plates is determined by using a layer model comprising:

modeling the profile part as a metal block that fills the space between the separating plates and comprises two planes, each plane in thermally conductive contact with a separating plate, and at least one plane having two surfaces between and parallel to the separating plates;

determining a total heat introduced via a fluid into the profile part and into the separating plate with a first heat introduction comprising heat transfer from the fluid into the profile part and subsequent heat conduction through the profile part and from the profile part into the separating plate; and introducing an amount of heat corresponding to the first heat introduction into a first surface within the metal block.

6. Process as claimed in claim 3, wherein the manufacturing of the heat exchanger comprises:

applying a solder to the surfaces of separating plates;

stacking the separating plates and profiles on top of one another in alternation; and soldering the profiles to the separating plates.

7. Process as claimed in claim 1, wherein the three-dimensional numerical simulation of the temperature stresses further comprises determining the fluid temperature and heat transfer coefficient between a fluid and the plate heat exchanger along the flow direction of the fluid.

8. Process as claimed in claim 1, comprising:

dividing the total heat introduced among the first heat introduction and a second heat introduction comprising heat transfer from the fluid into the bordering separating plate in the region of the profile part; and introducing an amount of heat corresponding to the second heat introduction into a second surface in a contact plane between the metal block and the separating plate.

9. Process as claimed in claim 7, wherein the heat transfer coefficient for the heat transfer between the fluid and the plate-type heat exchanger is multiplied by a heat transfer correction factor which corrects the heat introduction.

10. Process as claimed in claim 8, wherein the area of the first and second surface is multiplied by a surface correction factor.

11. Process as claimed in claim 1, wherein the thermal conductivity coefficient of the metal block is multiplied by a thermal conductivity correction factor which takes into account its homogeneous structure.

12. Process as claimed in claim 1, wherein the heat capacity or the density of the metal block is multiplied by a capacity correction factor.

13. Process as claimed in claim 1, further comprising:

determining the spatial stress distribution in the profiles and in the separating plates based on the temperature distribution determined in the layer model and on the modulus of elasticity of the metal block and the separating plates.

14. Process for producing a plate-fin heat exchanger comprising:

defining one or more mechanical parameters of a plate-fin heat exchanger by using a numerical three-dimensional simulation of temperature stresses inside the heat exchanger during operation, said plate-fin heat exchanger comprising layers, each layer comprising separating plates and a fin located between the separating plates, said fin comprising a profile part extending between the separating plates and adjoining the separating plates; and manufacturing such plate-fin heat exchanger having the one or more mechanical parameters by soldering, wherein, in the three-dimensional numerical simulation, a spatial temperature distribution in the fin and in separating plates of the plate-fin heat exchanger is determined by using a layer model comprising:

modeling a profile part as a metal block that fills the space between the separating plates and comprises two planes, each plane in thermally conductive contact with a separating plate, and at least one plane having two surfaces between and parallel to the separating plates;

determining a total heat introduced by a fluid into the profile part and into the separating plate corresponding to a first heat introduction comprising a) heat transfer from the fluid into the profile part and b) heat conduction through the profile part and from the profile part into the separating plate; and introducing an amount of heat corresponding to the first heat introduction into a first surface within the metal block.

15. Process according to claim 14, wherein the one or more mechanical parameters comprise at least one of the thickness of a fin or the thickness of a wall material.

16. Process according to claim 14, wherein the one or more mechanical parameters comprise the type of fin.

17. Process according to claim 16, wherein the type of fin is selected from the group consisting of plain fins, plain-perforated fins, serrated fins, wavy fins, and herringbone fins.

18. Process according to claim 3, wherein the one or more mechanical parameters comprises one or more of thickness of a plate, thickness of a fin, or type of fin.

19. Process according to claim 3, wherein each layer further comprises a distributor profile.

20. Process as claimed in claim 3, wherein the three-dimensional numerical simulation further comprises determining fluid temperature and heat transfer coefficient between a fluid and the plate heat exchanger along a flow direction of the fluid.

21. Process as claimed in claim 3, wherein the numerical simulation further comprises:

dividing the total heat introduced between the first heat introduction and a second heat introduction comprising heat transfer from the fluid into the separating plate in a region of the profile part; and introducing an amount of heat corresponding to the second heat introduction into a second surface in a contact plane between the metal block and a separating plate.

22. Process as claimed in claim 20, wherein a heat transfer coefficient for the heat transfer between the fluid and the plate-type heat exchanger is multiplied by a heat transfer correction factor which corrects the heat introduction.

23. Process as claimed in claim 21, wherein the area of the first and second surface is multiplied by a surface correction factor.

24. Process as claimed in claim 20, wherein the thermal conductivity coefficient of the metal block is multiplied by a thermal conductivity correction factor which takes into account its homogeneous structure.

25. Process as claimed in claim 3, wherein the heat capacity or the density of the metal block is multiplied by a capacity correction factor.

26. Process as claimed in claim 3, further comprising determining the spatial stress distribution in the profiles and in the separating plates based on the temperature distribution determined in the layer model and on the modulus of elasticity of the metal block and the separating plates.

27. Process as claimed in claim 3, wherein the metal block is in thermally conductive contact with two separating plates and the first surface within the metal block is parallel to the separating plates.

* * * * *